US007055710B2

(12) United States Patent
King

(10) Patent No.: US 7,055,710 B2
(45) Date of Patent: Jun. 6, 2006

(54) PLUG SEALS FOR USER-FRIENDLY CAP ASSEMBLIES

(75) Inventor: Roger Milner King, Buckinghamshire (GB)

(73) Assignee: Beeson and Sons Limited, Hertfordshire (GB)

( * ) Notice: Subject to any disclaimer, the term of this patent is extended or adjusted under 35 U.S.C. 154(b) by 0 days.

(21) Appl. No.: 10/432,310

(22) PCT Filed: Nov. 20, 2001

(86) PCT No.: PCT/GB01/05106

§ 371 (c)(1),
(2), (4) Date: May 21, 2003

(87) PCT Pub. No.: WO02/42171

PCT Pub. Date: May 30, 2002

(65) Prior Publication Data

US 2004/0035818 A1 Feb. 26, 2004

(30) Foreign Application Priority Data

Nov. 21, 2000 (GB) ..... 0028346.5

(51) Int. Cl.
*B65D 53/00* (2006.01)

(52) U.S. Cl. ..... 215/344; 215/DIG. 1

(58) Field of Classification Search ..... 215/344, 215/DIG. 1, 343, 345, 346, 330, 354, 252
See application file for complete search history.

(56) References Cited

U.S. PATENT DOCUMENTS 3,074,579 A * 1/1963 Miller ..... 215/344

(Continued)

*Primary Examiner*—Lien M. Ngo
(74) *Attorney, Agent, or Firm*—Stephen B. Salai, Esq.; Brian B. Shaw, Esq.; Harter, Secrest & Emery LLP

(57) ABSTRACT

The invention provides a container closure assembly comprising: a container neck having side walls defining an opening at one end thereof and a lip extending around the opening, wherein an inner surface of the side walls proximate to said lip is inwardly tapered; a closure for said neck, the closure having a base portion and a skirt portion; a first screw thread on the neck; a second screw thread on an inner surface of the skirt of the closure; said first and second screw threads being configured to enable a user to secure, remove and resecure the closure into a sealing position on the neck by rotation of the cap on the neck; a sealing plug extending from said base portion of the closure inside and substantially concentric with said skirt portion of the closure, wherein the sealing plug comprises a plurality of circumferential sealing ribs on an outer surface of said sealing plug for engagement with said inner surface of the container neck when the closure is secured on the container neck; at least one flexible sealing fin between the sealing plug and the closure skirt for engagement with the lip of the container when the closure is secured on the container neck; and at least one circumferential sealing rib on an inner surface of said closure for engagement with an outer surface of the container neck proximate to said lip when the closure is secured on the container neck. The assembly is especially suitable for forming gas-tight seals on carbonated beverage containers.

22 Claims, 3 Drawing Sheets

U.S. PATENT DOCUMENTS 3,473,685 A * 10/1969 Karlan ..... 215/253
3,532,244 A * 10/1970 Yates, Jr. ..... 215/272
3,568,871 A * 3/1971 Livingstone ..... 215/344
3,944,104 A * 3/1976 Watson et al. ..... 215/307
4,380,304 A * 4/1983 Anderson ..... 220/782
4,560,077 A * 12/1985 Dutt ..... 215/307
5,161,707 A 11/1992 Dutt et al.
5,275,287 A * 1/1994 Thompson ..... 215/344
5,297,688 A * 3/1994 Beck et al. ..... 215/344
5,871,111 A * 2/1999 Pfefferkorn et al. ..... 215/307
6,325,226 B1 * 12/2001 Krautkramer ..... 215/252
6,338,414 B1 * 1/2002 Schellenbach ..... 215/252

* cited by examiner

PLUG SEALS FOR USER-FRIENDLY CAP ASSEMBLIES

The present invention relates to improved seals for container closure assemblies. The invention is especially applicable to the sealing of containers in substantially gas-tight and liquid-tight fashion, such as the sealing of carbonated and non-carbonated beverage containers.

It is well known to provide beverage containers of glass, paper, card, metal or plastic having a screw top that can be resecured on the bottle neck. It is desirable to provide such containers with a screw top closure assembly that provides an airtight and liquid-tight seal to retain the quality of the beverage both during initial transport and storage, and after partial consumption of the contents when the closure has been resecured onto the container neck.

Certain existing container and closure assemblies make use of an elastomeric liner in the base of the closure cap. This liner is pressed against the lip of the bottle neck when the cap is screwed firmly onto the bottle neck, and the compression between the soft, deformable liner and the lip of the container provides a tight seal. Unfortunately, the manufacture and insertion of the liner into the closure cap are relatively costly additional process steps. Furthermore, care must be taken not to over-tighten such closures onto the container neck, since the liner can become brittle or damaged if excessive pressure is applied thereto.

It is also known to provide a cylindrical plug seal projecting downwardly from the base of the closure cap, such that the plug forms an interference fit with an inner surface of the bottle neck close to the lip of the bottle. Effective sealing by such plug seals requires the cap to be screwed down very tightly on the container neck in order to deform the base of the cap and thereby force the plug radially outwardly into a tight sealing engagement with the container neck. It is very often the case that such caps are under-tightened, especially by children and elderly users. Furthermore, a sufficient sealing force can only be achieved by the use of threads on the cap and the neck having a low pitch, such that the closure torque applied to the cap is leveraged into a very strong downward sealing force between the lip of the container and the closure base.

A need, therefore, exists for a screw-top container and closure arrangement that can provide an effective seal without the need for a liner, and also without the need for a strong axial sealing force between the container neck and the closure.

The present invention provides a container closure assembly comprising: a container neck having side walls defining an opening at one end thereof and a lip extending around the opening, wherein an inner surface of the side walls proximate to said lip is inwardly tapered; a closure for the neck, the closure having a base portion and a skirt portion; a first screw thread on the neck; a second screw thread on an inner surface of the skirt of the closure; said first and second screw threads being configured to enable a user to secure, remove and resecure the closure into a sealing position on the neck by rotation of the cap on the neck; a sealing plug extending from the base portion of the closure inside and substantially concentric with the skirt portion of the closure, wherein the sealing plug comprises a plurality of circumferential sealing ribs on an outer surface of said sealing plug for engagement with said inner surface of the container neck when the closure is secured on the container neck; at least one flexible sealing fin between the sealing plug and the closure skirt for engagement with the lip of the container when the closure is secured on the container neck; and at least one circumferential sealing rib on an inner surface of said closure for engagement with an outer surface of the container neck proximate to said lip when the closure is secured on the container neck.

Preferably, the closure assembly according to the present invention is applied to a carbonated beverage container, such as a molded plastic or glass carbonated beverage bottle.

The inventive arrangement of sealing ribs and sealing fins is new, and provides surprisingly improved sealing at low sealing forces. Preferably, there are two of said sealing ribs, but in some embodiments there are preferably from 3 to 10 of the ribs, and most preferably 4 to 6 ribs. Preferably, the taper of the inner sealing surface of the container neck is from 10 to 10° from the longitudinal axis of the neck, more preferably from 2° to 6°.

Preferably, at least one of the sealing ribs has a substantially triangular cross-section, for example substantially equilateral triangular. This enables the sealing force to be concentrated in the tip of the sealing rib to maximise sealing effectiveness. Preferably, at least one of the sealing ribs has a height in the range of 10 to 500 micrometers, more preferably 50 to 250 micrometers. Such micro sealing ribs are especially effective to concentrate the sealing force and achieve an effective seal with a substantially smooth sealing surface on the container neck. Furthermore, such micro ribs are especially easy to mold in high-speed cap moulding equipment, and to bump off the mold mandrel of the equipment after molding.

A further advantage of using multiple sealing ribs on the sealing plug is that the plurality of sealing ribs may have more than one height in order to optimise sealing. For example, the height of the sealing rib closest to the base of the closure may be greater than the height of the sealing rib remote from the base of the closure. This allows the sealing rib closest to the base of the closure (i.e. closest to the lip of the container) to deform more that the sealing rib furthest from the base of the closure.

Preferably, the outer surface of the sealing plug is tapered inwardly from the base of the closure. The mean angle of taper is preferably from 1° to 10° from the longitudinal axis of the neck, more preferably from 2° to 6°.

The sealing fins may have their base in the base of the closure between the skirt and the sealing plug, or they may extend inwardly or outwardly and downwardly from the base of the skirt or the sealing plug. Preferably, at least one of the sealing fins extends in a direction downwardly and outwardly from the base of the closure between the sealing plug and the closure skirt. Preferably, the closure comprises two or four sealing fins extending around the closure in concentric fashion. Preferably, two sealing fins are disposed substantially symmetrically on either side of the container lip to provide a balanced sealing pinch on the lip.

Preferably, the container closure assembly comprises a second sealing fin extending downwardly and inwardly from the base of the closure between the sealing plug and the closure skirt. The first and second sealing fins then seal against opposite sides of the container lip, preferably in substantially symmetrical and balanced fashion. The first and second sealing fins flex in opposite directions as the closure is secured onto the container neck. This dual action ensures that at least one, and usually both, of the sealing fins makes a pressure-tight seal against the lip.

Preferably, the height of the sealing fins is greater than their width at their base. Preferably, the cross-section of the sealing fins is substantially in the shape of an isosceles triangle. Preferably, at least one sealing fin has a height of from 1 to 4 mm.

The sealing fins alone may lack sufficient resilience to form a secure pressure-tight seal against the top of the container lip. Therefore preferably at least one stop surface is provided proximate to the base of the closure, positioned and arranged such that at least one sealing fin abuts against the stop surface when the closure is secured on the container neck. Preferably, two flexible fins are provided for sealing on either side of the container lip, as described above, and two stop surfaces are provided at the bases of the sealing plug and the closure skirt for abutment against each of the sealing fins at the fully secured and pressure-tight position.

Preferably, the container lip is rounded to provide for easy and comfortable drinking directly from the container neck, and more preferably it is fully radiused in cross-section. It is a further advantage of the present invention that the sealing arrangement is so effective that it can provide a pressure-tight seal on a fully radiused container lip.

The container closure assembly according to the present invention comprises a further circumferential sealing rib on an inner surface of the closure skirt for engagement with an outer surface of the container neck. More preferably, the circumferential sealing rib is located proximate to the base of the closure. Preferably the further circumferential sealing rib has the dimensions and shape as hereinbefore described for preferred embodiments of the sealing ribs on the sealing plug. Most preferably, the further circumferential sealing rib is located at substantially the same height above the base of the closure as one of the circumferential sealing ribs on the sealing plug, whereby it cooperates with the said one of the sealing ribs to provide sealing ribs symmetrically disposed on either side of the container lip to apply a symmetrical sealing pinch.

The container closure assembly according to the present invention is especially suitable for use in conjunction with thread arrangements that are quick and easy to secure and resecure, wherein the closure can be secured and resecured on the container neck by a single smooth rotation through 360° or less, more preferably 180° or less, and most preferably about 90°.

Preferably, the first and second threads are multiple start threads such as two-start threads or three-start threads, and more preferably they are four-start threads. This further assists securing of the closure on the neck, since the user needs to rotate the cap less in order to find a thread start. Preferably, the threads are substantially free-running or parallel threads. That is to say, the threads on the closure and cap slide past each other freely without forming an interference fit between the thread segments on the closure and cap.

Preferably, the first and second threads are continuous helical threads. That is to say, they are not bayonet-type threads that require a stepped motion of the closure to secure the closure on the neck, but rather they define a substantially continuous helical thread path having a thread gradient less than 90 degrees substantially throughout. Preferably the threads have a mean thread pitch of from 5° to 25°, more preferably from 10° to 20°.

Steeply pitched threads provide advantages in terms of ease of use and more reliable separation of tamper-evident rings from the closure skirt. However, it will be appreciated that such steeply pitched threads result in a relatively small leverage of rotational force applied to the closure into downward force on the closure, and it is a feature of the sealing arrangement according to the invention that it can provide a reliable pressure-tight seal without strong downward force being applied to the closure as in previous sealing arrangements.

Preferably, the container and closure further comprise complementary locking elements on the container neck and the closure that block or resist unscrewing of the closure from the fully secured position on the container neck until a predetermined minimum opening torque is applied. More preferably, the locking elements comprise a longitudinal locking rib on one of the container neck or the skirt portion of the closure, and a complementary locking ramp on the other of the container neck and the skirt portion of the closure, said locking rib abutting against the retaining edge of the locking ramp when the closure is fully secured on the container neck.

The locking arrangement helps to prevent the closure from backing off under pressure from inside the container. It also provides a positive click that indicates to the user when the closure has been screwed onto the neck sufficiently to achieve a pressure-tight seal.

Preferably, the container closure assembly according to the present invention further comprises a projecting stop surface on one of the container neck and the closure skirt for abutment against a second stop or a thread on the other of the container neck or the closure to block over-tightening of the closure beyond a predetermined angular sealing position of the closure on the container neck. The stop means acts in conjunction with the locking arrangement to ensure that exactly the right degree of screwing of the closure is achieved in order to provide a pressure-tight seal with the sealing arrangement of the present invention.

Suitable locking and stop arrangements are described in detail in WO 91/18799 and WO 95/05322, the active contents of which are expressly incorporated herein by reference.

Preferably, the torque required to secure the closure in a, sealing position on the container neck is less than 1.2 Nm, more preferably less than 1 Nm and most preferably from about 0.7 to about 0.9 Nm. This is the torque required to engage the complementary locking arrangement (where present) at the sealing position, or otherwise the force required to substantially eliminate gas leakage at normal carbonated beverage pressure differentials.

Preferably, the assembly achieves a sealing pressure around at least one circumferential surface between the container neck and the closure at the fully closed position of at least about 7 MPa (1000 psi), preferably at least about 10.5 MPa (1500 psi), preferably over a temperature range of from about 0° C. to about 40° C., and preferably over an pressure range within the container of from about zero to about 1.2 MPa gauge (175 psig), i.e. covering the maximum ranges of temperature and pressure required for carbonated beverages. Preferably, the assembly provides at least two such circumferential seals, preferably over the whole of the above temperature and pressure ranges.

An embodiment of the present invention will now be described further by way of example with reference to the accompanying drawings, in which:

FIG. 1 shows a comparative view of a container neck (in elevation) and a closure (in cross section) secured to the neck in a sealing position, wherein the left side of the closure is shown with a prior art sealing liner and the right side of the closure is shown with a sealing arrangement in accordance with the present invention; and FIG. 2 shows a detailed view in cross section of the lip region of a container closure assembly according to the present invention from FIG. 1, with the closure at the sealing position. The deformation of the closure and stress contours are shown in the drawing as calculated by Finite Element Analysis for an unpressurized container at 32° C. (90° F.);

Figure 1:
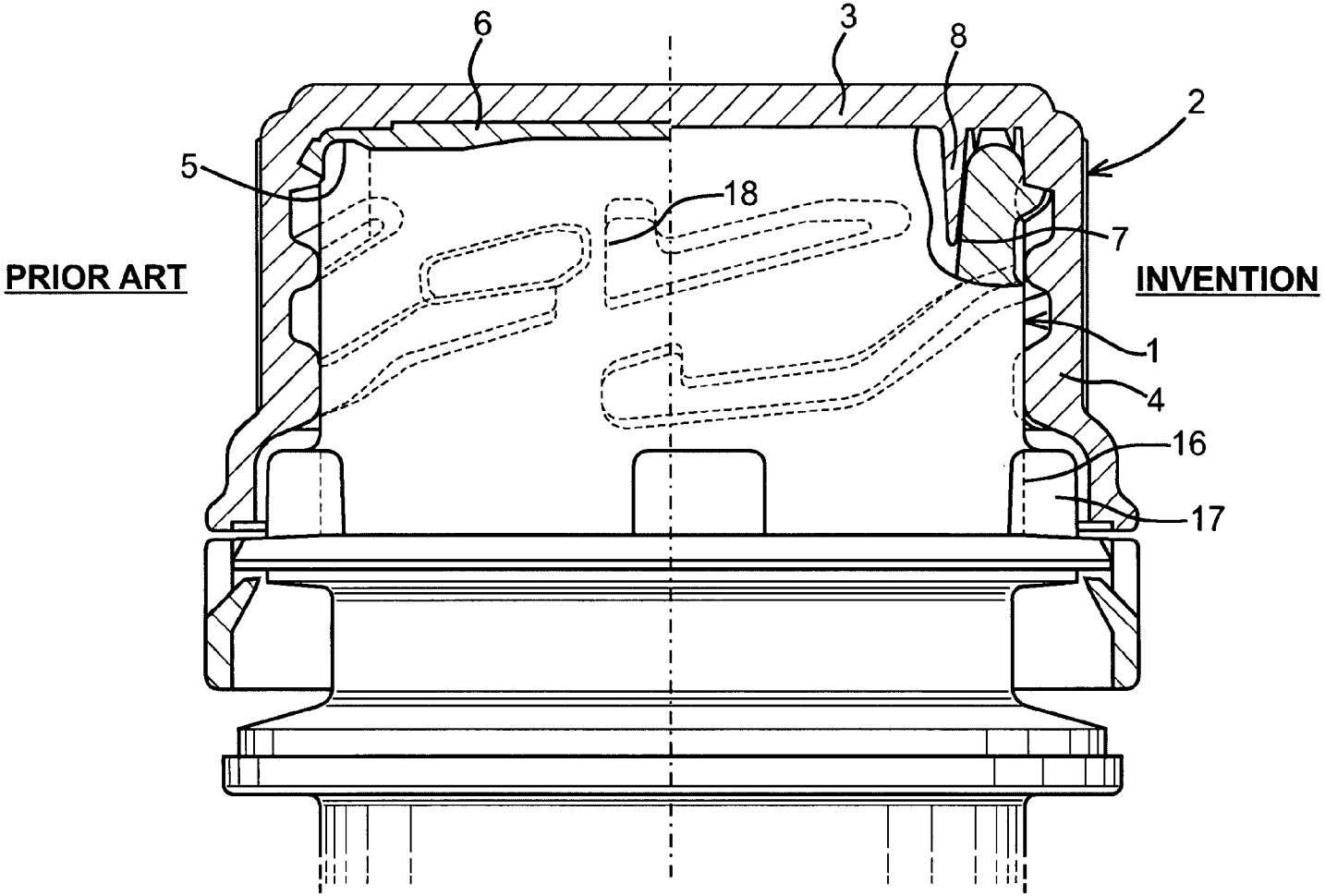

Referring to FIG. 1, the container neck 1 and closure 2 are provided with fast-turn, steeply-pitched threads incorporating a pressure safety feature. The details of the construction and manufacture of these threads is described in detail in our International patent applications WO 95/05322, WO 97/21602 and WO 99/19228, the entire contents of which are expressively incorporated herein by reference. They will not be described further here.

The closure 2 comprises a base 3 and a skirt 4. The container neck 1 terminates in a rounded, smooth surfaced lip 5. Conventionally, this lip forms a pressure-tight seal with an elastomeric liner 6 shown hatched in the "prior art" portion of FIG. 1.

Referring to FIGS. 1 and 2 to 5, the improved sealing arrangement according to the present invention comprises an inwardly tapered inner surface 7 of the container neck adjacent to the lip. A cylindrical sealing plug 8 projects downwardly from the base of the closure cap, and is itself tapered substantially in parallel with the inner surface of the neck. However, instead of a simple interference fit between the sealing plug and the container neck, there are provided two substantially circumferential continuous sealing ribs 9 on the outer surface of the sealing plug. The circumferential sealing ribs 9 have a substantially equilateral triangular cross-section, and are approximately 150 micrometers high, in the unstressed state. However, they deform as shown in the drawings when pressed against the normally harder material (glass or PET) of the container neck to form the pressure-tight seal. The small dimensions of the sealing ribs enable a pressure tight seal to be achieved without substantial force having to be applied to the sealing plug to form the seal.

Two flexible sealing fins 10, 11 extend downwardly by about 2 mm from the base of the closure between the closure skirt and the sealing plug. The sealing fins flex in opposite directions to form seals substantially symmetrically on either side of the rounded top of the container lip as the sealing position is reached. A tight seal is assured by abutment of the sealing fins 10, 11 against the respective stop surfaces 12, 13.

Finally, a further circumferential sealing rib 14 is provided on the skirt of the closure close to the base of the closure for engagement with an outer surface of the container closure close to the lip. The unstressed shape and size of the sealing rib 14 is preferably similar to the preferred ranges for the sealing ribs 9. Again, the small size of the sealing rib 14 enables an effective seal to be achieved without a high sealing force. Furthermore, in use, the sealing rib 14 is located substantially opposite the sealing rib 15 located closest to the base of the closure on the sealing plug. The sealing ribs 14 and 15 cooperate to pinch the container lip to provide highly effective seals over the whole range of temperature and pressure.

Figure 3:
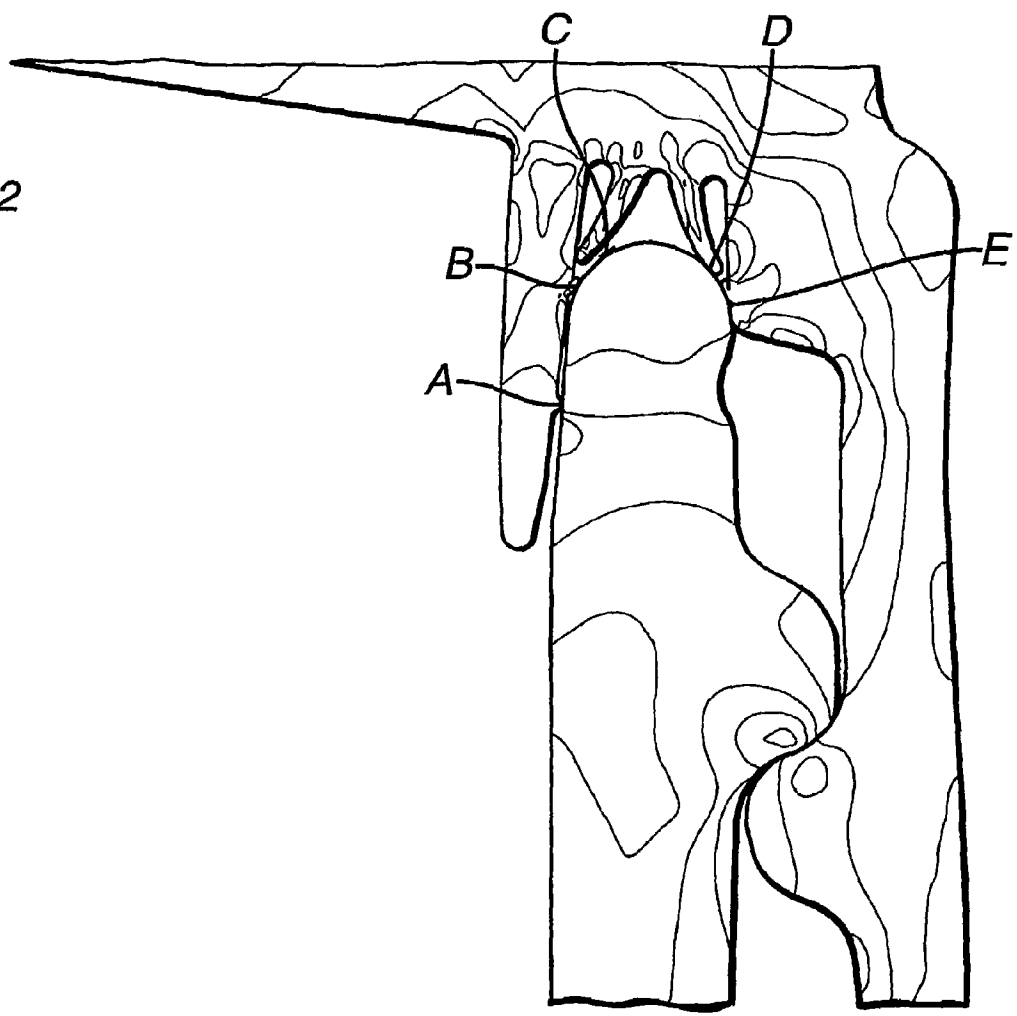
FIG. 3 shows a detail view calculated in similar fashion as for FIG. 2 for a container pressurized to 0.71 MPa gauge (103 psig) at 32° C. (90° F.)
Figure 2:
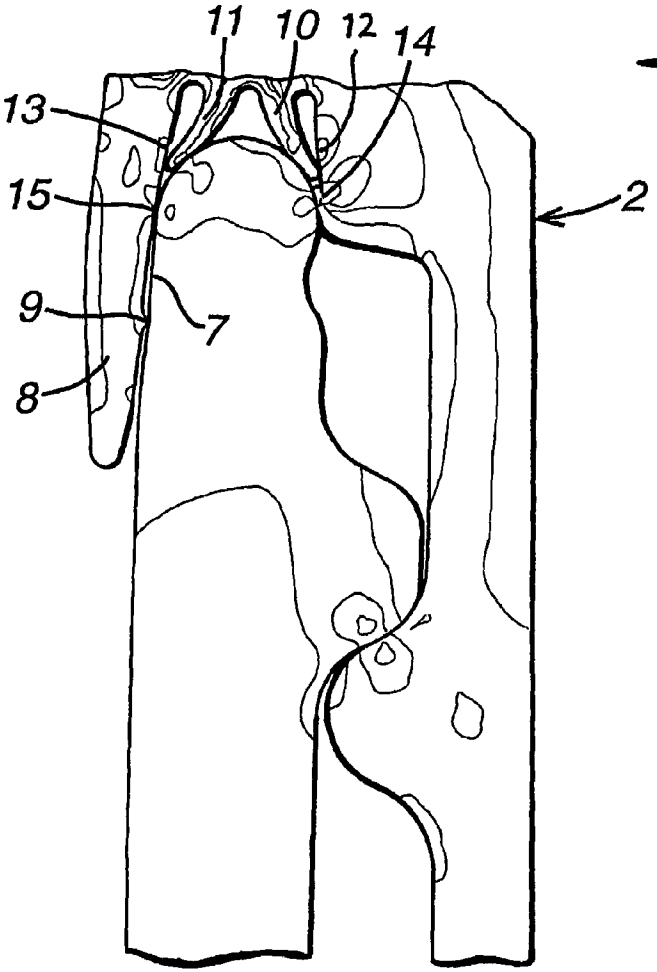
Figure 5:
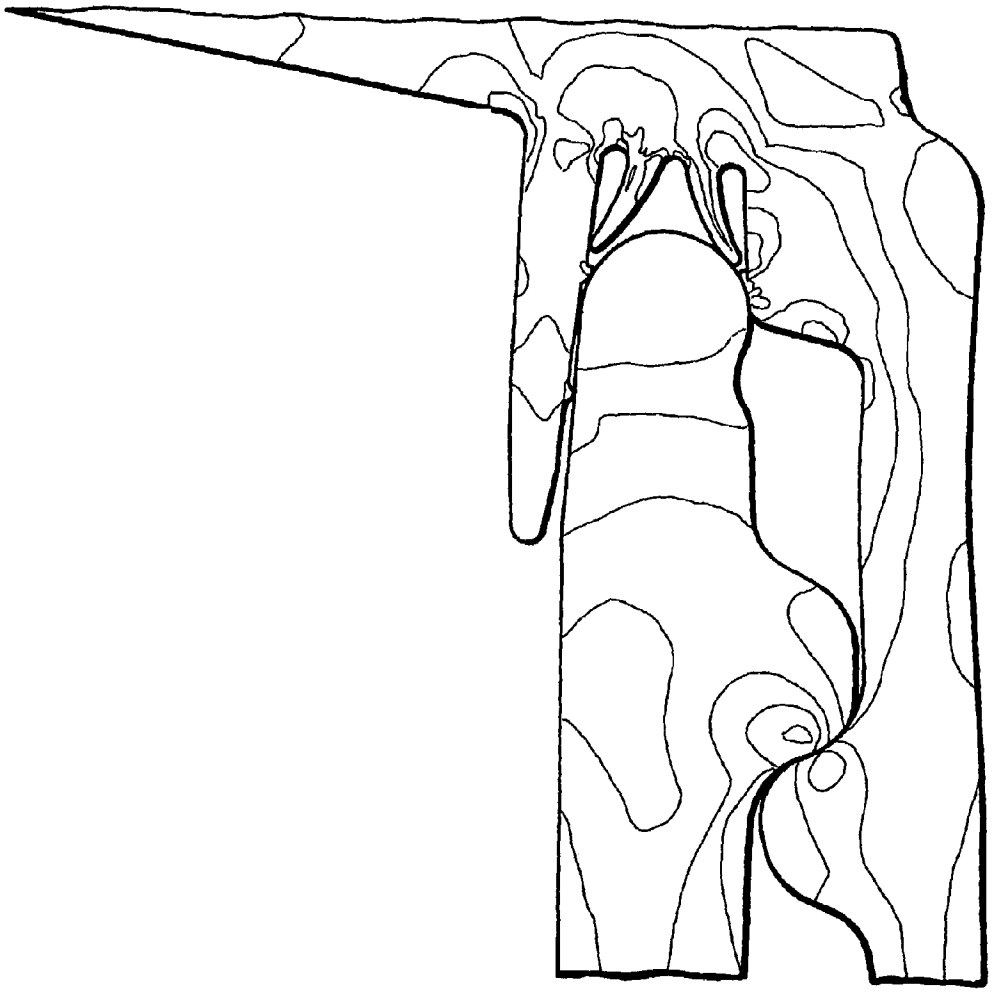
FIG. 5 shows a detail view calculated in similar fashion as for FIG. 2 for a container pressurized to 0.71 MPa gauge (103 psig) at 42° C. (108° F.)
Figure 4:
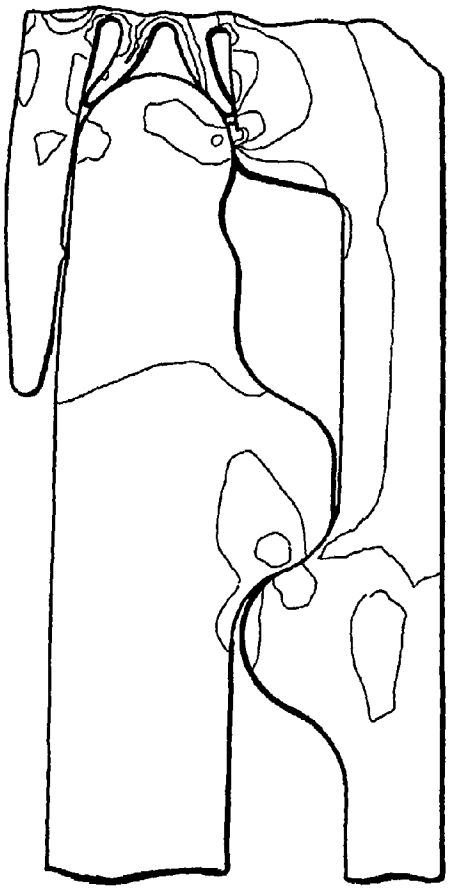
FIG. 4 shows a detail view calculated in similar fashion as for FIG. 2 for an unpressurized container at 42° C. (108° F.)

The above arrangement provides five distinct circumferential sealing surfaces, designated A to E in FIG. 3. The contact pressures in MPa at these surfaces were calculated for by finite element analyses. These calculations were made assuming that conventional polyethylene materials were used for the closure and conventional PET for the container neck, and further assuming typical carbonated beverage container neck dimensions). The calculated values in MPa are as follows:

| | A | B | C | D | E |
|---|---|---|---|---|---|
| FIG. 2 | 5.2 | 28.3 | 28.3 | 19.3 | 28.3 |
| FIG. 3 | 26.9 | 26.9 | N/a | 4.1 | 26.9 |
| FIG. 4 | 5.9 | 26.2 | 9.7 | 6.9 | 26.2 |
| FIG. 5 | 29.6 | 0 | N/a | 6.1 | 29.6 |

The sealing arrangement enables the closure to be secured and resecured on the container neck without the need for high torque or low pitched threads to force a seal. There is a complementary locking arrangement 16, 17 on the container neck and the closure as described in the International patent applications listed above to signal to the user by means of a click when a sealing engagement has been achieved. The locking arrangement is also associated with a stop surface 15 to prevent over-tightening of the closure on the neck, but in any case the sealing arrangement according to the invention is less sensitive to over tightening because there is no elastomeric liner.

Note that the assembly according to the invention uniquely provides at least two circumferential seals having a sealing pressure greater than 10 MPa over the whole range of temperature and pressure normally encountered in carbonated beverage containers. It can also be seen that the flexible fins undergo very little plastic deformation in the closed and sealing position, whereby they permit the closure to be resecured on the neck in pressure-tight fashion, for example if only a part of the contents of the container is consumed immediately after opening. It can further be seen that the closure is suitable for application to container necks having rounded top lips, such as glass container necks and plastic container necks having a rounded lip to assist drinking directly from the neck.

The above embodiment has been described by way of example only. Many other embodiments falling within the scope of the accompanying claims will be apparent to the skilled reader.

The invention claimed is:

1. A container closure assembly comprising:

a container neck having side walls defining an opening at one end thereof and a lip extending around the opening, wherein an inner surface of the side walls proximate to said lip is inwardly tapered;

a closure for said neck, the closure having a base portion and a skirt portion;

a first screw thread on the neck;

a second screw thread on an inner surface of the skirt of the closure;

said first and second screw threads being configured to enable a user to secure, remove and resecure the closure into a sealing position on the neck by rotation of the cap on the neck;

a sealing plug extending from said base portion of the closure inside and substantially concentric with said skirt portion of the closure, wherein the sealing plug comprises a plurality of circumferential sealing ribs on an outer surface of said sealing plug for engagement with said inner surface of the container neck when the closure is secured on the container neck;

at least one flexible sealing fin between the sealing plug and the closure skirt for engagement with the lip of the container when the closure is secured on the container neck;

at least one circumferential sealing rib on an inner surface of said skirt of the closure for engagement with an outer surface of the container neck proximate to said lip when the closure is secured on the container neck; wherein in use a first one of said sealing ribs on the plug is located substantially the same longitudinal distance from the base portion of the closure as a first one of the at least of circumferential sealing rib on the inner surface of the skirt closure, whereby the lip of the container neck is pinched between the said first sealing ribs when the closure is in the secured position on the container neck.

2. A container closure assembly according to claim 1, wherein at least one of the sealing ribs on the plug or the inner surface of the closure has a substantially triangular cross-section.

3. A container closure assembly according to claim 1, wherein the sealing ribs on the plug or the inner surface of the closure have a height in the range of 10 to 250 micrometers.

4. A container closure assembly according to claim 1, wherein the plurality of sealing ribs on the sealing plug have more than one height.

5. A container closure assembly according to claim 4 wherein the sealing rib, on the sealing plug furthest from the base of the closure has a greater height than the sealing rib closest to the base of the closure.

6. A container closure assembly according to claim 1, wherein the outer surface of the sealing plug is tapered inwardly from the base of the closure.

7. A container closure assembly according to claim 1, wherein at least one said sealing fin extends downwardly and outwardly from the base of the closure between the sealing plug and the closure skirt.

8. A container closure assembly according to claim 7, further comprising a second sealing fin extending downwardly and inwardly from the base of the closure between the sealing plug and the closure skirt.

9. A container closure assembly according to claim 1, wherein at least one said sealing fin has a height of from 1 to 4 mm.

10. A container closure assembly according to claim 1, wherein at least one stop surface is provided proximate to the base of the closure, whereby at least one sealing fin abuts against the stop surface when the closure is secured on the container neck.

11. A container closure assembly according to claim 1, wherein the container lip is semi-circular.

12. A container closure assembly according to claim 1, wherein the closure can be secured and resecured on the container neck by a single smooth rotation through 360° or less, preferably through 180° or less, and more preferably through about 90°.

13. A container closure assembly according to claim 1, wherein the first and second threads are multiple start threads.

14. A container closure assembly according to claim 1, wherein the first and second threads are substantially continuous helical threads.

15. A container closure assembly according to claim 1, wherein the container and closure further comprise complementary locking elements on the container neck and the closure that block or resist unscrewing of the closure from the fully secured position on the container neck until a predetermined minimum opening torque is applied.

16. A container closure assembly according to claim 1, further comprising a projecting stop surface on one of the container neck and the closure skirt for abutment against a second stop or a thread on the other of the container neck or the closure to block over-tightening of the closure beyond a predetermined angular sealing position of the closure on the container neck.

17. A container closure assembly according to claim 1, wherein the torque required to secure the closure in a sealing position on the container neck is from about 0.7 Nm to about 0.9 Nm.

18. A container closure assembly according to claim 1, wherein the assembly achieves a sealing pressure around at least one circumferential surface between the container neck and the closure at the fully closed position of at least about 7 MPa (1000 psi).

19. A container closure assembly according to claim 18, wherein the assembly provides at least two such circumferential seals between the container neck and the closure at the fully closed position.

20. A beverage container comprising a container closure assembly according to claim 1.

21. A beverage container according to claim 20 which is a carbonated beverage container.

22. A container closure assembly comprising:

a skirt portion;

a base portion;

a sealing plug extending from the base portion of the closure inside and substantially concentric with the skirt portion;

a plurality of circumferential sealing ribs on an outer surface of said sealing plug for engagement with an inner surface of a container neck when the closure is secured on the container neck;

at least one flexible sealing fin between the sealing plug and the skirt portion for engagement with a lip of the container when the closure is secured on the container neck;

at least one circumferential sealing rib on an inner surface of the skirt of said closure for engagement with an outer surface of the container neck proximate to said lip when the closure is secured on the container neck in which a first one of the plurality of circumferential sealing ribs on the outer surface of the sealing plug and at least one circumferential of sealing rib on the inner surface of the skirt of the closure are substantially the same longitudinal distance from the base of the closure; and the closure further comprising at least on stop surface proximate to the base portion and engaging the at least one flexible sealing fin when the closure is secured on a container neck.

* * * * *